United States Patent [19]

Vermeulen et al.

[11] Patent Number: 4,772,536

[45] Date of Patent: Sep. 20, 1988

[54] DYE IMAGE RECEIVING MATERIAL

[75] Inventors: Leon L. Vermeulen, Herenthout; Ludovicus H. Vervloet, Kessel; Willy P. De Smedt, Mecehelen, all of Belgium

[73] Assignee: Agfa-Gevaert, N.V., Mortsel, Belgium

[21] Appl. No.: 65,874

[22] Filed: Jun. 24, 1987

[30] Foreign Application Priority Data

Jul. 4, 1986 [BE] Belgium ..... EP86201179.8

[51] Int. Cl.[4] ..... G03C 5/54; G03C 1/76

[52] U.S. Cl. ..... 430/213; 430/941; 428/424.6; 428/520

[58] Field of Search ..... 430/213, 941; 428/424.6, 520

[56] References Cited

U.S. PATENT DOCUMENTS 4,186,014 1/1980 Bergthaller et al. ..... 430/213

*Primary Examiner*—Richard L. Schilling

*Attorney, Agent, or Firm*—A. W. Breiner

[57] ABSTRACT

An image receiving material suitable for image production by dye diffusion transfer processing controlled by the development of (an) image-wise exposed silver halide emulsion layer(s), wherein the support of said material is a resin support coated with gelatin in admixture with a cationic polymeric mordant containing glycidyl groups that can react with active hydrogen atoms of the gelatin, wherein said support is made of a vinyl chloride polymer and said support is coated with an image receiving layer wherein the weight ratio of said polymeric mordant to gelatin is from 25:1 to 2.5:1, and the gelatin coverage is at least 0.1 g per m2. In a particular embodiment the image receiving layer is used in the production of a laminar article serving as identification document.

4 Claims, No Drawings

DYE IMAGE RECEIVING MATERIAL

DESCRIPTION

The present invention relates to a material containing an image receiving layer suitable for carrying out a dye diffusion transfer processing controlled by the development of a photo-exposed silver halide emulsion layer.

The use of image receiving materials in the silver complex diffusion transfer reversal (DTR-) process is well known state of the art.

A more recently developed diffusion transfer reversal process is based on the image-wise transfer of diffusible dye molecules from an image-wise exposed silver halide emulsion material into a waterpermeable image receiving layer containing a mordant for the dye(s) . The image-wise diffusion of the dye(s) is controlled by the development of one or more image-wise exposed silver halide emulsion layers, that for the production of a multicolour image are differently spectrally sensitized and contain respectively a yellow, magenta and cyan dye molecules. A survey of dye diffusion transfer imaging processes has been given by Christian C. Van de Sande in Angew. Chem.—Ed. Engl. 22 (1983) n° 3. 191–209.

For use in dye diffusion transfer photography the type of mordant chosen will depend upon the dye to be mordanted. If acid dyes are to be mordanted. the image-receiving layer contains basic polymeric mordants such as polymers of amino-guanidine derivatives of vinyl methyl ketone such as described in U.S. Pat. No. 2,882,156, and basic polymeric mordants and derivatives, e.g. poly-4-vinylpyridine, the metho-p-toluene sulphonate of 2-vinylpyridine and similar compounds described in U.S. Pat. No. 2,484,430, and the compounds described in the published DE-A Nos. 2,009,498 and 2,200,063. Other mordants are long-chain quaternary ammonium or phosphonium compounds of ternary sulphonium compounds, e.g. those described in U.S. Pat. Nos. 3,271,147 and 3,271,148,, and cetyltrimethylammonium bromide. Certain metal salts and their hydroxides that form sparingly soluble compounds with the acid dyes may be used too. The dye mordants are dispersed or molecularly divided in one of the usual hydrophilic binders in the image-receiving layer. e.g. in gelatin, polyvinylpyrrolidone or partly or completely hydrolysed cellulose esters.

In U.S. Pat. No. 4,186,014 cationic polymeric mordants are described that are particularly suited for fixing anionic dyes, e.g. sulphinic acid salt dyes that are image-wise released by a redox-reaction described in U.S. Pat. No. 4,232,107.

Said cationic polymeric mordants contain glycidyl groups that can react with active hydrogen atoms being present in gelatin serving as binding agent. Such polymers can be made by quaternizing a basic polyurethane, polyurea or polyurea-polyurethane with a quaternizing agent capable of introducing glycidyl groups.

The mordant layer contains preferably said cationic polymeric mordant in quantites of from 10 to 70% by weight based on the total solids content of the mordant layer. An image receiving layer on the basis of said mordant is applied to polyester resin supports.

When as support for the above composed image receiving layer a support of a vinyl chloride polymer is used, that is preferred for use in the production of laminates by heat sealing, there is a problem with the adherence of said receiving layer to the support. The dye image receiving layer on a vinyl chloride support must remain securely anchored thereto in dry as well as in wet conditions. Such is particularly important when vinyl chloride supports are used in the production of tamperproof identification cards.

It is an object of the present invention to provide an image receiving material wherein a waterpermeable image receiving layer containing a mordant is adequately secured in dry as well as in wet state to a vinyl chloride polymer support.

It is an other object of the present invention to use said image receiving material in the production of a strongly sealed laminate serving as identification document.

Other objects and advantages of the present invention will appear from the following description.

In accordance with the present invention an image receiving material suitable for image production by dye diffusion transfer processing controlled by the development of (an) image-wise exposed silver halide emulsion layer(s) is provided, wherein the support of said material is a resin support coated with an image receiving layer containing gelatin in admixture with a cationic polymeric mordant containing glycidyl groups that can react with active hydrogen atoms of the gelatin, characterized in that the support is substantially consisting of a vinyl chloride polymer and the image receiving layer coated thereon has a weight ratio of said polymeric mordant to gelatin from 25:1 to 2.5:1, preferably a weight ratio 5:1. the gelatin being present at a coverage of at least 0.1 g per m2.

The term "vinyl chloride polymer" includes the homopolymer, as well as any copolymer containing at least 50 % by weight of vinyl chloride units and including no hydrophilic recurring units.

Vinyl chloride copolymers serving as the support may contain one or more of the following comonomers : vinylidene chloride, vinyl acetate, acrylonitrile, styrene, butadiene, chloroprene, dichlorobutadiene, vinyl fluoride, vinylidene fluoride, trifluorochloroethylene, and tetrafluoroethylene.

The vinyl chloride polymer serving as the support may be chlorinated to contain 60–65 % by weight of chlorine.

Many properties of polyvinyl chloride and its copolymers are improved by plasticzation and their stability can be improved by stabilizers well known to those skilled in the art (see. e.g., F. W. Billmeyer, Textbook of Polymer Chemistry, Interscence Publishers, Inc., New York (1957) p. 311–315) ).

The vinyl chloride polymer support may contain pigments or dyes as colouring matter e,g. in an amount up to 5 % by weight. An opaque white appearance may be obtained by incorporation of white pigments, e.g. titanium dioxide particles.

The cationic polymeric mordant containing glycidyl groups that can react with active hydrogen atoms being present in the gelatin serving as binding agent is preferably a basic polyurethane, polyurea or polyurea-polyurethane consisting of from 0 to 30 mole % of recurrent units derived from a modifying monomer selected from the group consisting of monofunctional and trifunctional alcohols, amines, and isocyanates and from 70 to 100 moles % of recurrent units of the general formula:

(—A—B—)

in which segment A is derived from a diol, hydroxy alkylamine or diamine containing at least one tertiary amino group by removal of two terminal hydrogen atoms and corresponds to the general formula:

$$-X_1-(CH_2)_{m1}-\overset{\overset{\displaystyle R^1}{|}}{N}-(CH_2)_{m2}-X_2-$$

$R_1$ represents individually or in combination, straight or branched chain alkyl, alkoxyalkyl, aralkyl, a disubstituted aminoalkyl group of the formula:

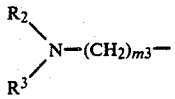

or an ethylene or 1,2-propylene group which is attached to $X_1$ or $X_2$ through the second bond with formaton of a piperazine ring. $R_2$ and $R_3$ which may be the same or different represent alkyl groups selected from the group consisting of from 1 to 4 carbon atoms or together the atoms required to complete a pyrrolidine, piperidine or morphiline ring.

$X_1$ and $X_2$ which may be the same or different, respresent —O—, —NH—, —$NR_4$— or a group of the formula —$NR_4$—$(CH_2)_{m4}$—$X_3$— in which:

$R_4$ represents an alkyl group having from 1 to 4 carbon atoms or when only one of te groups $X_1$ or $X_2$ is —$NR_4$—$(CH_2)_{m4}$—$X_3$—, $R_4$ may together with $R_1$ form an ethylene or a 1,2-propylene group.

$X_3$ represents —O—, —NH— or —$NR_4$— and may be the same as or different from $X_1$ and $X_2$, and $m_1$ to $m_4$ represent 2 or 3, but in the case of m1 or m2 only the value 2 may occur when $R_1$ and $R_4$ together form an ethylene or 1,2-propylene group, and wherein segment A contains up to 40% of the tertiary amino group being quaternized with a quaternizing agent carrying glycidyl groups, and the remainder of the tertiary amino groups being at least partially:

(i) quaternized with quaternizing agents absent glycidyl groups, or (ii) neutralized with an acid, and in which segment B is derived from a bis-chloroformate, a diisocyanate or an isocyanate prepolymer having two isocyanate end groups, and is represented by te formula:

—CO—Y—CO— wherein Y represents, individually or in combination, —O—$R_5$—O—, —NH—$R_6$—NH— or —NH—$R_6$—NH—CO—O—$R_7$—O—CO—NH—$R_6$—NH—.

wherein:

$R_5$ represents individually or in combination an alkylene group unsubstituted or substituted by alkyl group or interrupted by ether oxygen atoms, $R_6$ represents individually or selectively in combination an alkylene group unsubstituted or substituted with alkyl groups, a cycloalkylene group or an arylene group;

$R_7$ represents any divalent group not containing any other Zerewitinoff active group or a group capable of reacting with isocyanate groups, provided that Y can represent —$OR_5O$ only when $X_1$ or $X_3$ are not —O—.

The preparation of said cationic polymeric mordant proceeds as described in U.S. Pat. No. 4,186,014.

A mordant having particularly good fixing power for anionic dyes is called mordant A and has the following structure (the percentage values are mole %):

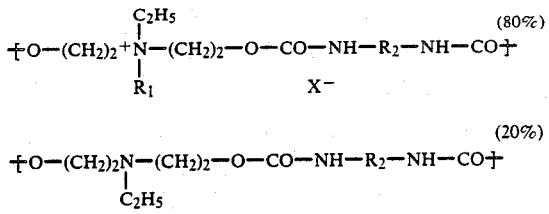

(80%)

(20%)

$R_1$ = 50% —$C_2H_5$ + 50% —$CH_2$—$CH_2$— 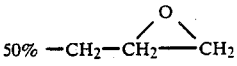

$R_2$ = 70% — 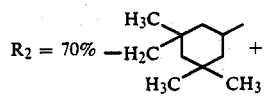 + 26% — 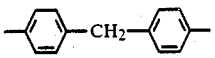

$X^-$ = 50% $C_2H_5SO_4^-$ + 50% $Cl^-$

Said mordant is prepared analogously to Example 12 of U.S. Pat. No. 4,136,014.

Generally, good results are obtained when the dye image-receiving layer is about 2 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkylphenols. etc.

Use of pH-lowering material in the dye-imaging-receiving element will usually increase the stability of the transferred image. Generally, the pH-lowering material will effect a reduction of the pH of the image layer from about 13 or 14 to at least 11 and preferably to 5 to 7 within a short time after treatment. For example, polymeric acids as disclosed in U.S. Pat. No. 3,362,819 of Edwin H. Land. issued Jan. 9, 1968, or solid acids or metal salts, e.g. zinc acetate, zinc sulphate, magnesium acetate, etc., as disclosed in U.S. Pat. No. 2,584,030 of Edwin H. Land, issued Jan. 29, 1952, may be employed with good results. Such pH-lowering materials reduce the pH of the film unit after development to terminate development and substantially reduce further dye transfer and thus stabilize the dye image.

The image receiving layer in the dye image receiving material according to the present invention has a high resistance to abrasion and yields very rapidly a touch dry dye image.

To reduce repellence on coating and improving coating speed the vinyl chloride resin support is pre-treated with a corona discharge by passing the support, e.g. in sheet or belt form, between a grounded conductive roller and corona wires whereto an alternating current (AC) voltage is applied with sufficiently high potential to cause ionization of the air. Preferably the applied peak voltage is in the range of 10 to 20 kV. An AC corona unit is preferred because it does not need the use of a costly rectifier unit and the voltage level can be easily adapted with a transformer. In corona-discharge treatment with an an AC corona unit a frequency range from 10 to 100 kHz is particularly useful. The corona-treatment can be carried out with material in the form of a belt or band at a speed of 10 to 30 m per min while operating the corona unit with a current in the range of 0.4 to 0.6 A over a belt or band width of 25 cm.

The corona-discharge treatment makes it possible to dispense with a solvent treatment for attacking and roughening the surface of the resin support and is less expensive and more refined in its application.

After the obtaining of the dye image in the image receiving layer it is advantageous to remove adhering chemicals stemming from e.g. the photographic processing or used in that processing. It has been established experimentally that chemicals such as photographic silver halide developing agents impair the adherence in a lamination step and therefore a cleaning step is preceding preferably the lamination for removing these chemicals. The cleaning proceeds preferably with the aid of a dissolved detergent that diminishes the surface tension in aqueous medium. Any commercial detergent can be used for that purpose. A survey of detergents can be found in the book: "McCutcheon's Detergents & Emulsifiers 1978 North American Edition—McCutcheon Division. MC Publishing Co. 175 Rock Road, Glen Rock, N.J. 07452 USA. Preference is given to anionic and non-ionic surface-active agents containing a polyethyleneoxide chain in their structure. Examples of such agents are described in U.S. Pat. No. 3,663,229.

The image-receving layer can form part of a separate image-receiving material or form an integral combination with the light-sensitive layer(s) of the photographic material with the proviso that the image receiving layer makes contact with a transparent vinyl chloride polymer support.

Where the image-receiving layer applied on said support after processing of the photosensitive material remains associated with the silver halide emulsion layer(s) an alkali-permeable light-shielding layer. e.g. containing white pigment particles is applied between the image-receiving layer and the silver halide emulsion layer(s) to mask the negative image with respect to the positive image as described e.g. in the book: "Photographic Silver Halide Diffusion Processes" by André Rott and Edith Weyde—The Focal Press—London—New York (1972) page 141.

The present image-receiving layer is particularly suited for application in the production of laminar articles comprising a dye image making part of an identification document, also called I.D. card, that contains a colour photograph by lamination sandwiched between a clear plastic protective cover sheet and a rear possibly opaque support sheet.

In view of the widespread use of I.D. cards as security document, e.g. to establish a person's authorization to conduct certain activities (e.g. driver's licence) or to have access to certain areas or to engage in particular commercial actions, it is important that forgery of the I.D. card by alteration of certain of its data and/or photograph is made impossible.

A laminar article according to the present invention comprises the above defined image receiving layer incorporating a dye image enveloped between a vinyl chloride polymer support and a resin cover sheet fixed to the image receiving layer by lamination using pressure and heat.

According to a preferred embodiment the cover sheet is a polyethylene terephthalate sheet being coated with a resinous melt-adhesive layer preferably a polyethylene layer.

The lamination of the present image receiving material with a covering hydrophobic resin film sheet material proceeds preferably by heat-sealing between flat steel plates under a pressure of e.g. 10 to 15 kg/cm2 at a temperature in the range of 120° to 150° C., e.g. at 135° C. or by using other apparatus available on the market for heat sealing lamination purposes. Cooling proceeds under pressure to avoid distortion.

The laminate may contain the image receiving layer over the whole area of the support or in a part thereof, e.g. leaving free the edge area as described in U.S. Pat. No. 4,425,421.

According to an embodiment the image receiving layer is coated onto an opaque polyvinyl chloride having a thickness of only 0.050 to 0.300 mm. A sheet of that thickness can receive printed data by means of a mechanical printing process. e.g. offset or intaglio printing. It can receive, before or after being coated with the image receiving layer, or before or after the dye transfer, additional security marks in the form of e.g. a watermark, finger prints, printed patterns known from banc notes, coded information. e.g. binary code information, signature or other printed personal data that may be applied with visibly legible or ultra-violet legible printing inks as described e.g. in GB patent No. 1,518,946 and U.S. Pat. No. 4,105,333.

Other possibilities to increase security against counterfeiting are the inclusion in the laminate of infra-red absorbing markings, magnetic dots or strips and electronic microcircuits either or not combinad with ultraviolet radiation absorbing markings hidden from visibility and/or holograms as described e.g. in DE-OS No. 2 639 952, GB-P No. 1,502,460 and 1,572,442 and U.S. Pat. No. 3,668,795. The holographic patterns may be obtained in silver halide emulsion layers, normally Lippmann emulsions, especially designed for that purpose and can either or not be combined with a photograph.

According to an embodiment the silver halide emulsion layer for producing the hologram is applied on one side of the transparent cover sheet used in the manufacture of a laminate according to the present invention and laminated to the image receiving layer either or not separated therefrom by a transparent resin intersheet being made of polyethylene or a resin sheet such as a polyvinyl chloride sheet being coated with polyethylene.

When the resin sheet used as support of the laminate has to possess a thickness required for an identification card to be inserted in a slot of an electronic identification apparatus several sheets of matted polyvinyl chloride are stacked and laminated so as to reach a final thickness of e.g. 0.075 to 1 mm. When this lamination to the desired thickness occurs after dye image formation on a relatively thin polyvinyl chloride support, treatment with detergent as referred to hereinbefore to remove adhering chemicals preferably preceeds the lamination. The laminar article contains in that case preferably in the polyvinyl chloride support sheet opacifying titanium dioxide and a suitable plasticizing agent. The support may be provided with an embossed structure.

The following comparative example illustrates the present invention without, however, limiting it thereto.

All parts, ratios and percentages are by weight unless otherwise stated.

EXAMPLE

An opaque polyvinyl chloride sheet having a width of 24 cm and a thickness of 200 μm was treated with an electrical discharge produced by a corona discharge apparatus operated under the following conditions :

film travelling speed: 20 m/min,
electrode spacing to film surface: 2 mm,
corona current: 0.55 A,
AC voltage difference (peak value): 10 kV,
frequency: 30 kHz.

Sample X

The corona-treated surface was coated with an aqueous coating composition to form thereon an image receiving layer X for dye diffusion transfer processing containing in dry state per m2 the following :

gelatin: 0.25 g
mordant A: 2.5 g

Sample Y

The corona-treated surface was coated with an aqueous coating composition to form thereon an image receiving layer Y for dye diffusion transfer processing containing in dry state per m2 the following:

gelatin: 0.5
mordant A: 2.5 g

Sample Z

The corona-treated surface was coated with an aqueous coating composition to form thereon an image receiving layer Z for dye diffusion transfer processing containing in dry state per m2 the following:

gelatin: 0.5 g
mordant A: 5.0 g

Sample P (not within the scope of the inventon)

The corona-treated surface was coated with an aqueous coating composition to form thereon an image receiving layer P (having a weight ratio of polymeric mordant to gelatin as described in U.S. Pat. No. 4,186,014) for use in dye diffusion transfer processing containing in dry state per m2 the following:

gelatin: 6.0 g
mordant A: 6.0 g

The above samples were processed in combination with a photographic dye diffusion transfer material as described in the Example of U.S. Pat. No. 4,496.645. Said photographic material was exposed with white light through a grey wedge having a constant 0.1 and thereupon contacted for 1 minute with an image receiving material having the composition described hereinafter in a diffusion transfer apparatus COPYPROOF CP 38 (trade name of Agfa-Gevaert N.V. Belgium) ) having in its tray a basic processing liquid of the following composition:

sodium hydroxide: 25 g
sodium orthophosphate: 25 g
cyclohexane dimethanol: 25 g
2,2'-methylpropylpropane diol 25
N-ethylbenzene-pyridinum chloride: 0.5 g
distilled water up to: 1000 ml During the dye diffusion transfer processing the image receving layer of Sample P due to its poor adherence was transferred onto the photographic material so that it was no longer available on the polyvinyl chloride sheet support.

After leaving the processing tray the samples X, Y and Z were led through a second tray containing an aqueous solution comprising 50 g/l of a surfactant having the following structural formula:

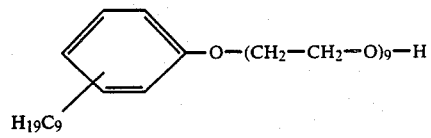

After drying the thus treated samples were laminated with a transparent cover sheet being a polypropylene sheet having a thickness of 30 μm being coated at one side with a thermoadhesive layer of polyethylene having a thickness of 30 μm. The lamination was carried out between flat steel plates pressing the layers together for 5 minutes using a pressure of 10 kg/cm2 at a temperature of 135° C. Said pressure was maintained during cooling to reach room temperature (20° C.) again.

The laminates with the samples X, Y and Z showed a sealing that was thus strong that on peeling apart the cover sheet the dye image was destroyed.

We claim:

1. An image receiving material suitable for image production of dye diffusion transfer processing controlled by the development of (an) image-wise exposed silver halide emulsion layer(s), wherein the support of said material is a resin support coated with an image receiving layer containing gelatin in admixture with a cationic polymeric mordant containing glycidyl groups that can react with active hydrogen atoms of gelatin, characterized in that the support substantially consists of a vinyl chloride polymer and the image receiving layer coated thereon has a weight ratio of said polymeric mordant or gelatin from 25:1 to 2.5:1, the gelatin being present at a coverage of at least 0.1 g per $m^2$, said cationic polymeric mordant being a basic polyurethane, polyurea or polyurea-polyurethane consisting of from 0 to 30 mole % of recurrent units derived from a modifying monomer selected from the group consisting of monofunctional and trifunctional alcohols, amines, and isocyanates and from 70 to 100 moles % of recurrent units of the general formula (—A—B—)

in which segment A is derived from a diol, hydroxy alkylamine or diamine containing at least one tertiary amino group by removal of two terminal hydrogen atoms and corresponds to the general formula:

$$-X_1-(CH_2)_{m1}-\overset{\overset{R^1}{|}}{N}-(CH_2)_{m2}-X_2-$$

wherein:

$R_1$ represents individually or in combination, straight or branched chain alkyl, alkoxyalkyl, aralkyl, a disubstituted aminoalkyl group of the formula:

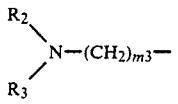

or an ethylene or 1,2-propylene group which is attached to $X_1$ or $X_2$ through the second bond with formation of a piperazine ring, $R_2$ and $R_3$ which may be the same or different represent alkyl groups selected from the group consisting of from 1 to 4 carbon atoms or together the atoms required to complete a pyrrolidine, piperidine or morphiline ring, $X_1$ and $X_2$ which may be the same or different, represent —O—, —NH—, —$NR_4$— or a group of the formula —$NR_4$—$(CH_2)$m4—$X_3$— in which:

$R_4$ represent an alkyl group having from 1 to 4 carbon atoms or when only one of the groups $X_1$ or $X_2$ is —$NR_4$—$(CH_2)$m4—$X_3$—, $R_4$ may together with $R_1$ form an ethylene or a 1,2-propylene group, $X_3$ represents —O—, —NH— or —$NR_4$— and may be the same as or different from $X_1$ and $X_2$, and m1 to m4 represent 2 or 3, but in the case of m1 or m2 only the value 2 may occur when $R_1$ and $R_4$ together form an ethylene or 1,2-propylene group, and wherein segment A contains up to 40% of the tertiary amino group being quaternized with a quaternizing agent carrying glycidyl groups, and the remainder of the tertiary amino groups being at least partially: (i) quaternized with quaternizing agents absent glycidyl groups, or (ii) neutralized with an acid, and in which segment B is derived from a bis-chloroformate, a diisocyanate or an isocyanate prepolymer having two isocyanate end groups, and is represented by the formula:

—CO—Y—CO—

Y represents, individually or in combination, —O—$R_5$—O—, —NH—$R_6$—NH— or —NH—$R_6$—NH—CO—O—$R_7$—O—CO—NH—$R_6$—NH—, wherein:

$R_5$ represents individually or in combination an alkylene group unsubstituted or substituted by alkyl group or interrupted by ether oxygen atoms, $R_6$ represents individually or selectively in combination an alkylene group unsubstituted or substituted with alkyl groups, a cycloalkylene group or an arylene group;

$R_7$ represents any divalent group not containing any other Zerewitinoff active group or a group capable of reacting with isocyanate groups, provided that Y can represent —$OR_5$—O only when $X_1$ or $X_3$ are not —O—.

2. A laminar article comprising a dye image in an image receiving layer according to claim 1, and wherein the image receiving layer is enveloped between a vinyl chloride polymer support and a resin cover sheet fixed to the image receiving layer by lamination using pressure and heat.

3. A laminar article according to claim 2, wherein the resin cover sheet is a polyethylene terephthalate sheet being coated with a resinous melt-adhesive layer.

4. A laminar article according to claim 3, wherein the resinous melt-adhesive layer is a polyethylene layer.

* * * * *